United States Patent [19]

Kilgore

[11] 4,363,606

[45] Dec. 14, 1982

[54] FREE PISTON PUMP FOR PUMPING LIQUIDS FROM A WELL

[76] Inventor: Raymond L. Kilgore, P.O. Box 1715, Corpus Christi, Tex. 78403

[21] Appl. No.: 164,635

[22] Filed: Jun. 30, 1980

[51] Int. Cl.[3] ..... F04B 47/12

[52] U.S. Cl. ..... 417/59; 92/207

[58] Field of Search ..... 417/56–59, 417/555 R, 555 A; 92/201–207

[56] References Cited

U.S. PATENT DOCUMENTS

| | | | |
|---|---|---|---|
| 889,275 | 6/1908 | Turner | 92/207 |
| 2,345,482 | 3/1944 | Keith | 92/207 |
| 2,674,951 | 4/1954 | Zaba | 417/59 |
| 3,249,056 | 5/1966 | Lyles | 417/59 |
| 3,273,504 | 9/1966 | Lyles | 417/59 |

*Primary Examiner*—Carlton R. Croyle
*Assistant Examiner*—Edward Look
*Attorney, Agent, or Firm*—Fulbright & Jaworski

[57] ABSTRACT

A free piston pump for use in a well for permitting gas to lift fluid to the well surface. The piston pump includes a body which supports a plurality of vertically and horizontally spaced piston segments which are sealingly engaged to form a piston. The segments are radially movable inwardly for allowing the retracted piston pump to move down the well conduit by gravity and are radially movable outwardly for engaging and sealing against the interior of the well conduit whereby gas under pressure lifts the piston and fluid thereabove to the surface. The segments are retracted when the pump reaches the top of the well and the segments are expanded when the pump reaches the bottom of the well. The segments include an inner arcuate surface and a tubular spring member is longitudinally positioned in the body and sealingly engages the inner surfaces. The segments are supported from the body by ribs and co-acting cam surfaces are provided between the body and the ribs for providing retraction and expansion of the piston segments.

8 Claims, 9 Drawing Figures

FREE PISTON PUMP FOR PUMPING LIQUIDS FROM A WELL

BACKGROUND OF THE INVENTION

Various types of plungers are used to lift fluids from an oil or gas well in which the plunger acts as a piston within a well conduit and gas under pressure, either natural or artificial, lifts the plunger and fluids to the surface. Such systems are used to dewater gas wells to prevent the water from impeding the flow of the gas, are used in oil wells having a high gas-oil ratio, and are used in other wells requiring removal of troublesome well liquids. By using a piston in the well conduit, a seal is obtained between gas and fluids including liquids to permit gas expansion, either natural or artificial, to lift the fluids. That is, gas under pressure lifts the piston and fluids to the surface and the piston is cycled to the bottom of the well to again entrap fluids and remove them from the well.

The present invention is directed to an improved piston pump which will automatically retract when the pump reaches the top of the well thereby returning to the bottom of the well by gravity, and will expand when the pump reaches the bottom of the well for entrapping and removing fluids from the well by the action of gas under pressure below the pump.

SUMMARY

The present invention is directed to a free piston pump for pumping liquids from a conduit in a well and includes a body with a plurality of vertically and horizontally spaced piston segments supported from the body and radially movable inwardly and outwardly. The vertically spaced piston segments are sealingly interengaged for forming a piston and the segments have an outer arcuate surface for sealing with the interior of a well conduit. Means are provided for retracting the segments when the body reaches the top of the well for allowing the pump to fall by gravity through the conduit, and means are provided for expanding the segments for sealing with the well conduit when the body reaches the bottom of the well.

A still further object of the present invention is the provision wherein the segments include an inner arcuate surface with means sealing the inner arcuate surface of the segments. Preferably, the seaing means is resiliently biased against the inner arcuate surfaces and includes a tubular spring member. Preferably, the tubular member extends below the segments and is opened at the bottom and is sealed at the top whereby pressure below the segments acts on the inside of the tubular member to urge the segments into an expanded position.

A still further object of the present invention is the provision of supporting the piston segments from the body by ribs and in which coacting cam surfaces are provided between the body and the ribs whereby movement of the ribs and the body cause retraction and expansion of the piston segments.

Still a further object is the provision wherein the means for retracting the segments includes a top plunger movably extending through the top of the body and spring means positioned between the top plunger and said ribs.

Still a further object is wherein the means for expanding the segments includes a bottom plunger movably extending through the bottom of the body for moving the ribs relative to the body when the pump engages the bottom of the well.

Still a further object is the provision of a piston pump in which the piston includes a first plurality of first piston segments supported from the body and having an outer arcuate surface and radially moves inwardly and outwardly, and a second plurality of second piston segments supported from the body and having an outer arcuate surface and radially moves inwardly and outwardly. The first plurality of segments and the second plurality of segments are positioned vertically adjacent each other and each of the first pistons sealingly contacts portions of two of the second pistons and each of the second pistons sealingly contacts portions of two of the first pistons thereby providing a retractible and expandable piston.

Other and further objects, features and advantages will be apparent from the following description of a presently preferred embodiment of the invention, given for the purpose of disclosure and taken in conjunction with the accompanying drawings.

DESCRIPTION OF THE PREFERRED EMBODIMENT

Figure 1A:
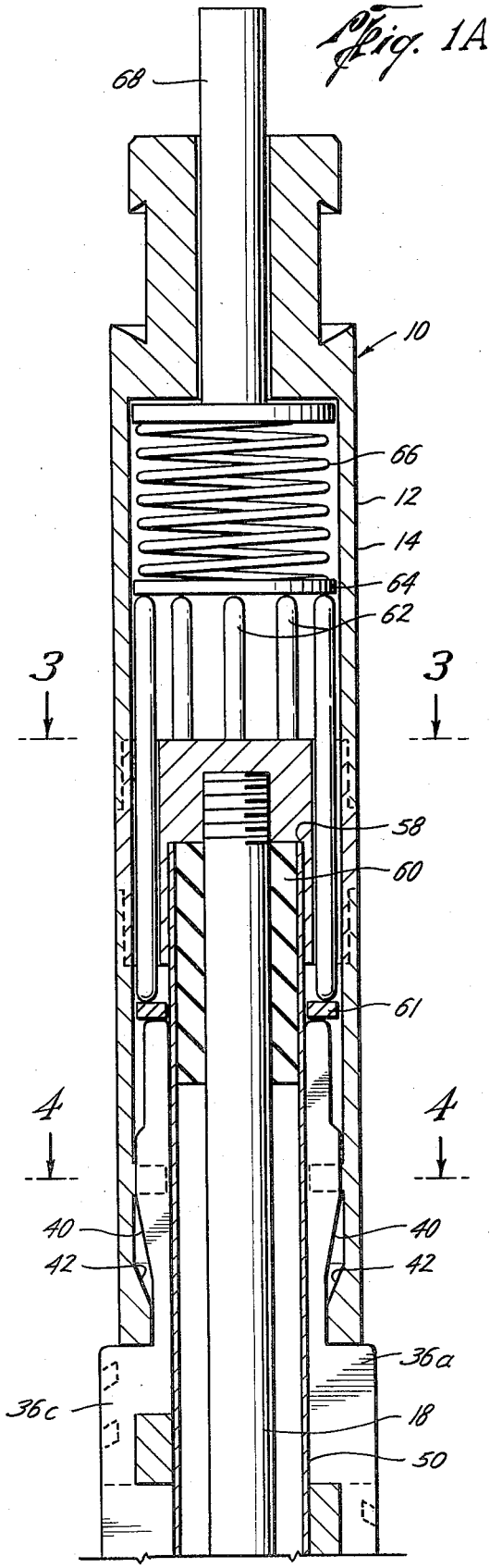
FIGS. 1A and 1B are continuations of each other of an elevational view, in cross section, of the apparatus of the present invention shown in the expanded position.

Referring now to the drawings, and particularly to FIGS. 1A, 1B, 2A and 2B, the reference numeral 10 generally indicates the free piston pump of the present invention and includes a body generally indicated by the reference numeral 12 which includes a top portion 14, a lower portion 16, and a connecting rod 18 between the top portion 14 and the lower portion 16.

A plurality of vertically and horizontally spaced piston segments are provided for forming a piston. Referring to FIGS. 1B, 2B, 5 and 6, a first plurality of horizontally positioned piston segments **20*a*, 20*b*, 20*c*, and 20*d*, are provided which are radially movable inwardly and outwardly. Each of the piston segments 20*a*, 20*b*, 20*c* and 20*d*, have an outer arcuate surface 22*a*, 22*b*, 22*c*, and 22*d*, for sealingly engaging with the interior of a well conduit 24. A second plurality of second piston segments 26*a*, 26*b*, 26*c* and 26*d*, are horizontally positioned relative to each other and positioned vertically adjacent the first plurality of first piston segments 20*a*, 20*b*, 20*c*, and 20*d*. The second plurality of piston segments 26*a*, 26*b*, 26*c*, and 26*d* are also movable inwardly and outwardly and have an outer arcuate surface 28*a***, 28*b*, 28*c*, and 28*d*, respectively, for sealingly engaging the interior walls of the well conduit 24.

In order that the first and second plurality of piston segments may be movable inwardly and outwardly and yet act together to provide a fluid seal, each of the first piston segments 20*a*, 20*b*, 20*c*, and 20*d*, sealingly contacts portions of two of the second pistons, and each of the second piston segments sealingly contacts portions of two of the first piston segments. Thus, piston segment 20*b* of the first plurality of segments sealingly contacts the top of piston segments 26*a*, and 26*b*. Similarly, piston segment 26*a* of the second vertically positioned segments sealingly contacts the bottom of portions of piston segments 20*a* and 20*b*, and piston segment 26*b* has its top in sealing contact with the bottom of piston segments 20*b* and 20*c*.

Additional plurality of horizontally positioned piston segments may be vertically positioned adjacent the first or second sets of piston segments in order to increase the sealing action of the seal, if desired. Thus additional sets of pluralities of piston segments may be provided such as 30*a–d* and 32*a–d*. While the number of piston segments in any horizontal layer as illustrated in the preferred embodiment is shown as four, either more or less may be provided as desired. And while any desired vertical layers may be provided, six is satisfactory.

The various piston segments are supported from the body 12 by ribs. Thus, ribs 36*a*, 36*b*, 36*c*, 36*d*, 36*e*, 36*f*, 36*g*, and 36*h*, are provided. Thus, ribs 36*a–d* support piston segments 20*a–d*, respectively, and in addition support any alternate sets of piston segments in other vertical layers such as piston segments 32*a–d*. Similarly, ribs 36*e–h* support piston segments 26*a–d* and any alternate piston segments in other vertical layers such as piston segments 30*a–d*. Thus the various ribs 36*a–h* support the piston segments, and keep them properly aligned for forming a sealing piston, and move inwardly and outwardly for expanding and retracting the piston segments.

Figure 2A:
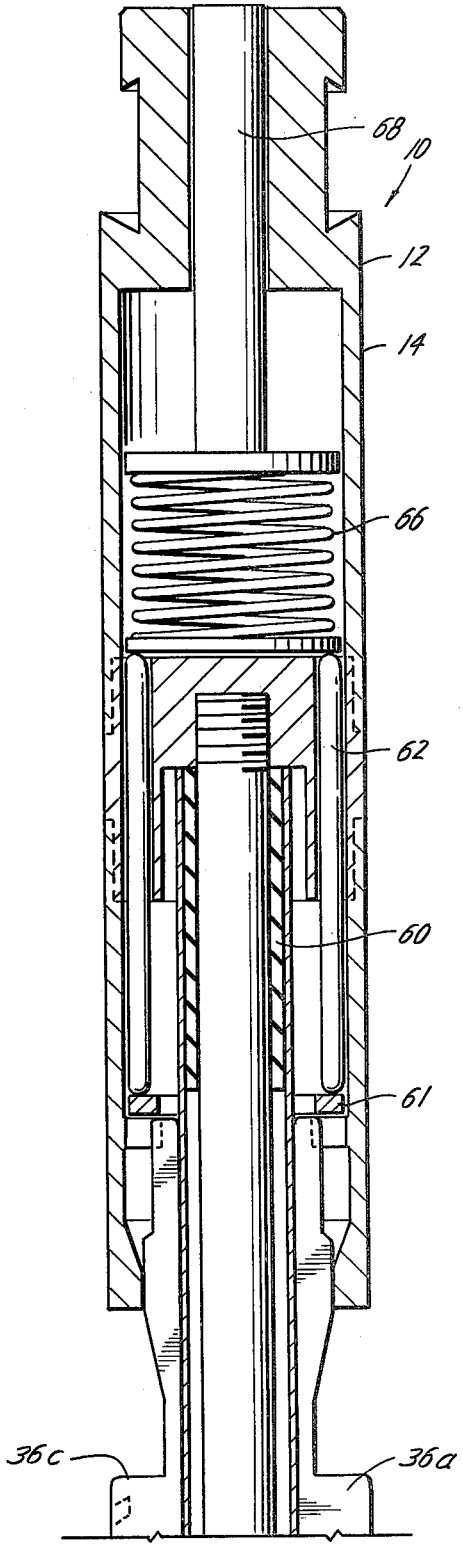
FIGS. 2A and 2B are continuations of each other of an elevational view, in cross section, of the apparatus of the present invention shown in the retracted position.
Figure 1B:
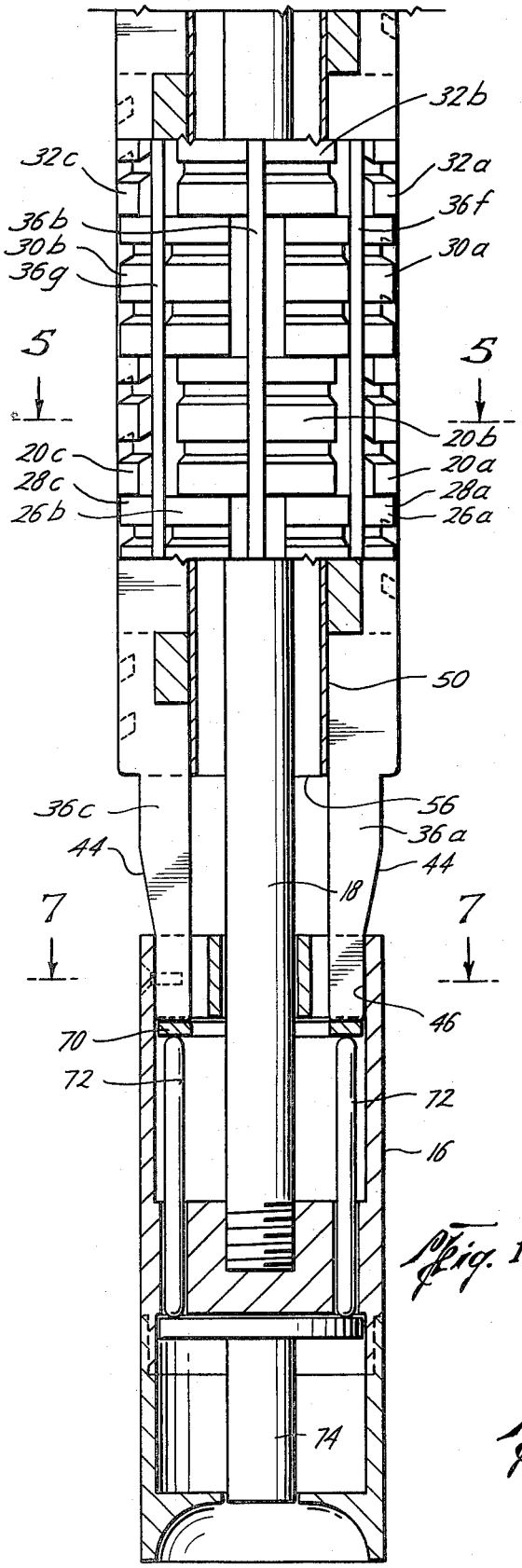
Figure 2B:
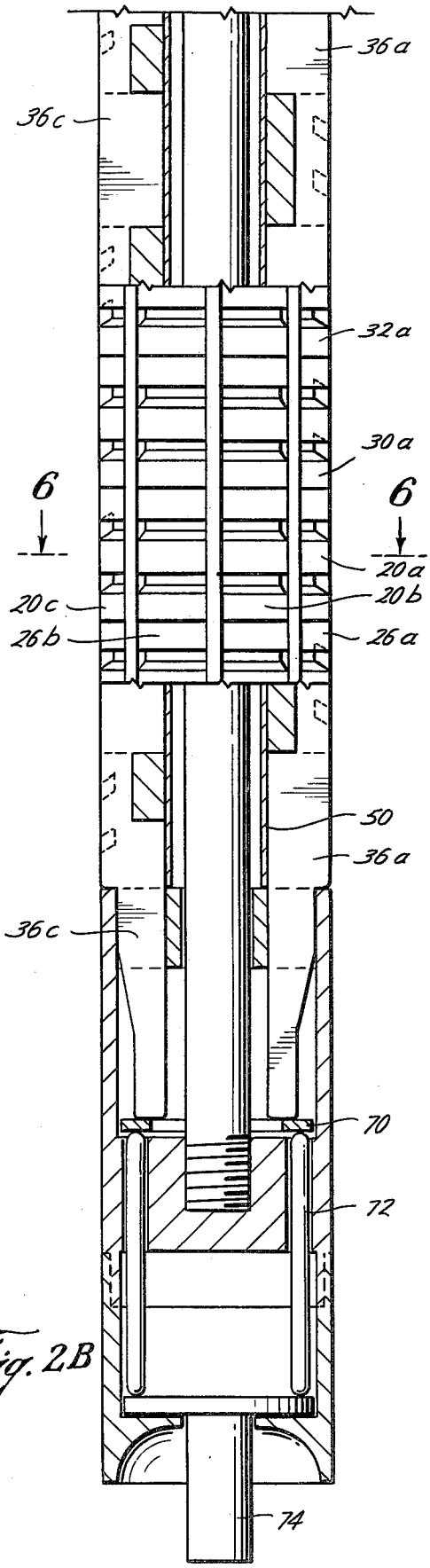
Figure 3:
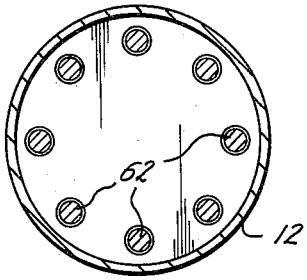
FIG. 3 is a cross-sectional view taken along the line 3—3 of FIG. 1A.
Figure 4:
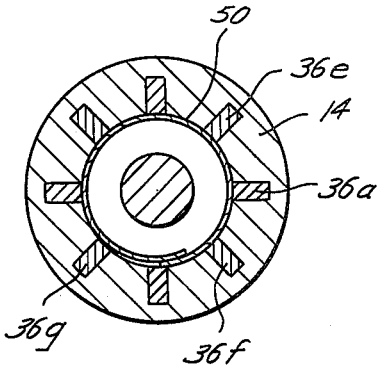
FIG. 4 is a cross-sectional view taken along the line 4—4 of FIG. 1A.
Figure 7:
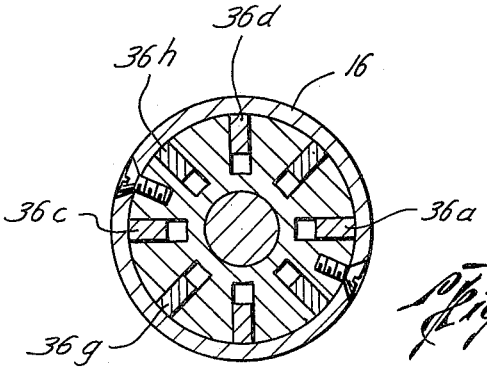
FIG. 7 is a cross-sectional view taken along the line 7—7 of FIG. 1B.

Coacting cam surfaces are provided between the body 12 and the ribs 36*a–h* for retracting and expanding the various piston segments. Referring to FIG. 1A, coacting cam surfaces 40 are provided on each of the ribs for coacting with cam surfaces 42 on the top body portion 14. Referring to FIG. 1B, cam surfaces 42 are provided on each of the ribs 36*a–h* for coacting with the surface 44 on the lower body portion 16. As shown in FIGS. 1A–1B, the ribs 36*a–h* are shown in an expanded position. However, as shown in FIGS. 2A and 2B, when the ribs are moved longitudinally relative to the body 12 the cam surfaces 40 and 42 and 44 and 46 are engaged, and the ribs 36*a–h* and thus the piston segments are retracted. As best seen in FIGS. 4 and 7, the top portions and the bottom portions of the ribs 36*a–h* are slideably supported from the top portion 14 of the body and the lower portion 16 of the body, respectively.

Figure 5:
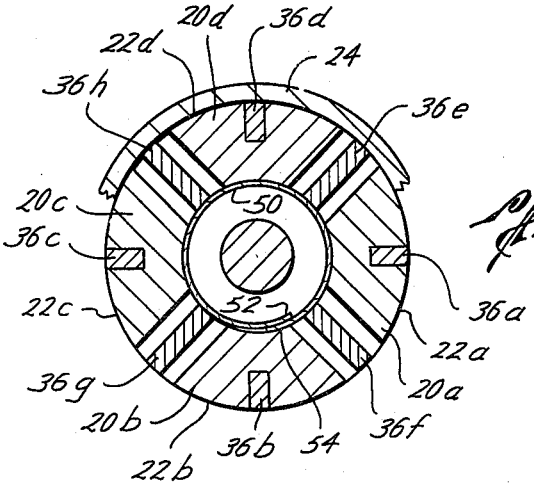
FIG. 5 is a cross-sectional view taken along the line 5—5 of FIG. 1B with the addition of a portion of a well conduit.
Figure 6:
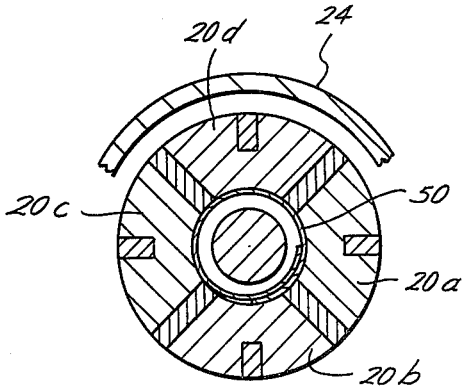
FIG. 6 is a cross-sectional view taken along the line 6—6 of FIG. 2B with the addition of a portion of a well conduit.

The various piston segments when expanded outwardly form a seal about the interior of the well conduit 24 and as previously described form a vertical seal with each other. Referring now to FIGS. 5 and 6, as the piston segments include an inner arcuate surface, and means are provided for sealing with the inner arcuate surfaces of the piston segments. Thus, a tubular spring member 50 is provided which coacts with and seals against the inner arcuate surfaces of all of the piston segments. The tubular member 50 includes overlapping edges 52 and 54 whereby the tubular member 50 may flex inwardly and outwardly in response to the inward and outward movement of the piston segments. Preferably, the tubular member 50 is a spring member which resiliently acts to bias the piston segments outwardly and urge them into a sealing relationship with the interior of the well conduit 24. Preferably, the lower end 56 of the tubular member 50 (FIG. 1B) is positioned below the various sets of piston segments and is open to the pressure in the well conduit 24 below the piston segments, and the upper end 58 of the tubular member 50 is sealed to the top portion 14 of the body 12 by a resilient seal 60. Therefore, when the apparatus 10 is positioned at the bottom of the well and gas pressure is applied against the bottom of the tool, the pressure will enter the tubular member 50 and further aid in biasing the piston segments to an outward position for sealing against the well conduit 24. Therefore, the tubular member 50 not only serves to provide a seal through the center of the piston formed by the various piston segments but also acts to bias the piston segments outwardly if not overcome by the coaction of the cam surfaces 40 and 42 and 44 and 46 between the ribs 36*a–h* and the top and bottom portions 14 and 16 of the body 12.

Suitable means are provided for retracting the various piston segments when the body 10 reaches the top of the well. Referring now to FIGS. 1A and 2B, a ring 61 is provided in the upper portion 14 of the body 10 against the upper end of the ribs 36*a–h*. The ring 60 in turn is engaged by a plurality of pins 62 which in turn engage a plate 64 which in turn contacts a spring 66 and which in turn engages a plunger 68 which movably extends through the top 14 of the body 10. As shown in FIGS. 1A and 1B, the apparatus 10 is in the expanded position with the ribs 36*a–h* in an upward position relative to the body 12. As the apparatus 10 moves up the well conduit 24 to the top of the well, the plunger 68 will engage a suitable abutment causing, as best seen in FIG. 2A, the plunger 68 to move downwardly through the top portions 14 of the body 12 compressing the spring 68, moving the pins 62 downwardly and in turn moving the ribs 36*a–h* downwardly to engage the cam surfaces 40 and 42 and the cam surfaces 44 and 46 to retract the ribs 36*a–h* inwardly as well as retracting all of the piston segments inwardly. Thereafter, the apparatus 10 is free to fall through the conduit 24 by gravity and will be held in the retracted position by the coacting cam surfaces 40 and 42 and 44 and 46.

However, when the apparatus 10 reaches the bottom of the well, suitable means are provided for expanding the piston segments outwardly to engage the interior of the well conduit 24. Referring now to FIGS. 1B and 2B, a ring 70 is provided adjacent the bottom end of the ribs 36*a–h* and is in turn engaged by a plurality of pins 72 which in turn engage a bottom plunger 74 which movably extends through the bottom 16 of the body 12. The apparatus 10 is in the retracted position shown in FIGS. 2A and 2B as it moves downwardly through the well conduit 24 by gravity with the bottom plunger 74 extending out of the bottom. When the apparatus 10 reaches the bottom of the well and contacts an abutment, the body 12 will move downwardly relative to the plunger pin 74 which will then move the ring 70 and ribs 36*a–h* upwardly relative to the body 12. Upward movement of the ribs 36*a–h* relative to the body 12 will release the ribs 36*a–h* and the piston segments to allow them to engage the interior of the well conduit 24 by the action of the tubular spring member 50. Therefore, as gas, either natural or artificial, is admitted to the lower side of the now expanded piston segments, the apparatus 10 will trap any fluids and particularly liquids thereabove and as the gas pressure increases the apparatus 10 will move up the well conduit 24 carrying the fluids up to the well surface where they will be suitably dumped. The apparatus 10 will again be retracted and fall through the well conduit 24 by gravity and the cycle will be repeated.

The present invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts will be readily apparent to those skilled in the art and which are encompassed within the spirit of the invention and the scope of the appended claims.

What is claimed is:

1. A free piston pump for pumping liquids from a conduit in a liquid-gas well comprising, a body, a plurality of vertically and horizontally spaced piston segments supported from the body and radially movable inwardly and outwardly, said vertically spaced piston segments being sealingly interengaged, said segments having an outer arcuate surface for sealing with the interior of a well conduit, means for retracting said segments when the body reaches the top of the well, means for expanding said segments when the body reaches the bottom of the well, said segments include an inner arcuate surface and means sealing the inner arcuate surfaces of said segments, and said sealing means includes a tubular spring member.

2. The apparatus of claim 1 wherein the tubular member extends below the segments and is open at the bottom and is sealed at the top whereby pressure below the segments acts on the inside of the member to urge the segments in the expanded position.

3. A free piston pump for pumping liquids from a conduit in a liquid-gas well comprising, a body, a plurality of vertically and horizontally spaced piston segments supported from the body and radially movable inwardly and outwardly, said vertically spaced piston segments being sealingly interengaged, said segments having an outer arcuate surface for sealing with the interior of a well conduit, means for retracting said segments when the body reaches the top of the well, means for expanding said segments when the body reaches the bottom of the well, the segments are supported from the body by ribs, and include coacting cam surfaces between the body and the ribs whereby movement between the ribs and the body allows retraction and expansion of the piston segments, said means for retracting the segments includes, a top plunger movably extending through the top of the body, and spring means positioned between the top plunger and said ribs.

4. A free piston pump for pumping liquids from a liquid-gas well comprising, a body, a first plurality of first piston segments supported from the body and having an outer arcuate surface and radially movable inwardly and outwardly, a second plurality of second piston segments supported from the body and having an outer arcuate surface and radially movable inwardly and outwardly, said first plurality of segments and said second plurality of segments positioned vertically adjacent each other and each of the first pistons sealingly contacts portions of two of the second pistons and each of the second pistons sealingly contacts portions of two of the first pistons, means for retracting said segments when the body reaches the top of the well, means for expanding said segments when the body reaches the bottom of the well, the segments include an inner arcuate surface, and a tubular spring member is longitudinally positioned in the body and sealingly engages the inner arcuate surfaces of said segments.

5. The apparatus of claim 4 wherein the segments are supported from the body by ribs, and including coacting cam surfaces between the body and the ribs whereby movement between the ribs and the body allows retraction and expansion of the piston segments.

6. The apparatus of claim 5 wherein the piston means for retracting the segments includes, a top plunger movably extending through the top of the body, and spring means positioned between the top plunger and said ribs.

7. The apparatus of claim 6 wherein the means for expanding the segments includes, a bottom plunger movably extending through the bottom of the body for moving said ribs relative to the body when the pump engages the bottom of the well.

8. A free piston pump for pumping liquids from a conduit in a liquid-gas well comprising, a body, a plurality of vertically and horizontally spaced piston segments supported from the body and radially movable inwardly and outwardly, said vertically spaced piston segments being sealingly interengaged, said segments having an outer arcuate surface for sealing with the interior of a well conduit, and having an inner surface, means for retracting said segments when the body reaches the top of the well, and means for expanding said segments when the body reaches the bottom of the well, said means including a vertically extending expandable fluid chamber engaging and sealing against the inner surface of said segments, said chamber having an opening at the bottom below the segments whereby pressure below the segments acts on the inside of the container to urge the segments into the expanded position.

* * * * *